US005267546A

United States Patent [19]

Siebert et al.

[11] Patent Number: 5,267,546

[45] Date of Patent: Dec. 7, 1993

[54] METHOD AND APPARATUS FOR CONTROLLING A FUEL PUMP

[75] Inventors: Hans-Joachim Siebert, Schwieberdingen; Nestor Rodriguez-Amaya; Joachim Tauscher, both of Stuttgart; Herbert Graf, Dornstetten; Werner Zimmermann, Stuttgart; Alfred Schmitt, Ditzingen, all of Fed. Rep. of Germany; Pierre Lauvin, Francheville, France; Anton Karle, Villingen, Fed. Rep. of Germany

[73] Assignee: Robert Bosch GmbH, Stuttgart, Fed. Rep. of Germany

[21] Appl. No.: 888,399

[22] Filed: May 21, 1992

Related U.S. Application Data

[63] Continuation of Ser. No. 647,575, Jan. 29, 1991, abandoned.

[30] Foreign Application Priority Data

Feb. 10, 1990 [DE] Fed. Rep. of Germany ..... 4004110

[51] Int. Cl.[5] ..... F02M 39/00

[52] U.S. Cl. ..... 123/500; 123/506

[58] Field of Search ..... 123/501, 502, 506, 503, 123/458, 500, 494

[56] References Cited

U.S. PATENT DOCUMENTS

| | | | |
|---|---|---|---|
| 4,395,987 | 8/1983 | Kobayashi | 123/506 |
| 4,495,915 | 1/1985 | Shinoda | 123/500 |
| 4,503,820 | 3/1985 | Nakagawa | 123/501 |
| 4,546,749 | 10/1985 | Igashira | 123/506 |
| 4,642,793 | 2/1987 | Miyaki | 123/501 |
| 4,653,454 | 3/1987 | Konishi | 123/506 |
| 4,782,803 | 10/1988 | Kikuchi | 123/506 |
| 4,884,549 | 12/1989 | Kelly | 123/506 |

FOREIGN PATENT DOCUMENTS

| | | |
|---|---|---|
| 3540313 | 5/1986 | Fed. Rep. of Germany . |
| 3540811 | 5/1987 | Fed. Rep. of Germany . |

*Primary Examiner*—Carl S. Miller

*Attorney, Agent, or Firm*—Kenyon & Kenyon

[57] ABSTRACT

A method and apparatus for controlling the flow of fuel for a gasoline or diesel gasoline engine controls a solenoid valve for actuating the fuel pump. A pump piston is driven by the camshaft and, in turn, pressurizes the fuel for delivery to the individual cylinders. Based on the operation of the solenoid valve, the beginning of the injection of fuel and the end of the injection of fuel are established Based upon spaced angular markings on the camshaft, a control unit determines the trigger signals for actuating the solenoid valve. To calculate the trigger signals, the markings on the camshaft are counted and interpolated therebetween over time. The interpolation is based on the instantaneous rotational speed N of the camshaft, which is sensed immediately before performing the interpolation.

6 Claims, 6 Drawing Sheets

METHOD AND APPARATUS FOR CONTROLLING A FUEL PUMP

This is a continuation of application Ser. No. 647,575, filed Aug. 29, 1991 now abandoned, entitled

METHOD AND APPARATUS FOR CONTROLLING A FUEL PUMP.

FIELD OF THE INVENTION

The present invention relates to methods and apparatus for controlling fuel pumps for internal combustion engines.

BACKGROUND INFORMATION

A method and a device for controlling a fuel pump are shown in German Published Patent Application No. 35 40 811. The system shown uses a solenoid valve for controlling the fuel pump for a diesel or gasoline engine. A pump piston is driven by a camshaft within a pump working space and, thus, pressurizes the fuel in the space. The fuel is then pumped to the individual cylinders of the engine by means of a fuel line. A solenoid valve is located between a fuel supply tank and the pump working space. An electronic control unit transmits control pulses to the solenoid valve. The solenoid valve opens and closes in response to the control pulses.

Based upon the circuit state of the solenoid valve, the pump piston delivers fuel into the combustion chambers of the engine. Drive pulses determine the point in time marking the beginning of the injection of fuel, and based upon the point in time that the injection of fuel is completed, the volume of fuel injected can be determined. Thus, with this system, it is not necessary to use metering groves, for example, to make a mechanical quantitative determination of the amount of fuel injected.

To establish the drive pulses, an increment wheel is mounted on the camshaft. After a synchronizing pulse appears, a counter is started, which counts the pulses on the increment wheel. After a specified number of pulses, the control system transmits a drive pulse to the solenoid valve. The drive pulse therefore defines the beginning of the injection of fuel. Subsequent counting of the increment pulses establishes the end of the injection of fuel.

One disadvantage of this device is that the meter-in flow control is relatively inaccurate. Since the drive pulses are established by counting the pulses of the increment wheel, the meter-in accuracy depends on the fineness of the increment wheel. Thus, both the beginning of the fuel flow output as well as the end of the fuel flow output are determined inaccurately. Due to limitations in manufacturing tolerances, only a finite number of teeth can be formed on the increment wheel. The pulses of the increment wheel are therefore spaced relatively far apart. This type of meter-in flow control is, accordingly, very inaccurate.

German Published Patent Application No. 35 40 313 which corresponds to U.S. Pat. No. 4,653,454, shows a method wherein the exact beginning of the fuel flow output can be established by using a solenoid valve mounted between the pump working space and the fuel supply. Mechanical components are used to determine the end of the injection of fuel and, consequently, the volume of fuel injected. The exact drive pulse indicating the beginning of the fuel injection is calculated in a manner similar to that described in German Published Patent Application No. 35 40 811. Proceeding from a synchronous pulse, the teeth on an increment wheel are counted. If the injection begins between two pulses of the increment wheel, then the remainder is interpolated therefrom. The interpolation is based upon a rotational frequency value averaged over several working cycles.

One problem with this system is that the rotational frequency can fluctuate over a single working cycle of the engine. The rotational frequency can also fluctuate from one working cycle to another. If an average rotational frequency value is used, as shown in German Published Patent Application No. 35 40 313, then the interpolation is likely to be very inaccurate due to changes in the rotational frequency during the meter-in flow control. The system shown in German Published Patent Application No. 35 40 313 attempts to compensate for these difficulties by using a correction factor which is dependent upon a characteristic map of performance data.

Even this correction factor, however, does not furnish sufficiently accurate values for indicating the beginning of the injection of fuel. Also, because the end of the injection of fuel is determined by mechanical components, an error occurring during the beginning of the fuel flow output can cause additional quantitative errors.

It is an object of the present invention, therefore, to provide a method and apparatus for controlling a fuel pump for a gasoline, diesel, or other type of internal combustion engine which overcomes the problems of such known methods and apparatus, and which accurately specifies both the beginning and the end of the injection of fuel.

SUMMARY OF THE INVENTION

The present invention is directed to a method for controlling a fuel pump for an internal combustion engine of a vehicle, wherein the fuel pump includes a piston driven by a camshaft of the engine for pressurizing the fuel located therein. A solenoid valve is coupled to the fuel pump and adapted to be actuated to open the fuel pump to initiate the flow of fuel therefrom and, in turn, actuated to close the fuel pump and stop the flow of fuel therefrom. The method comprises the following steps:

sensing the position of spaced angular marks located on the camshaft and generating first signals indicative thereof;

sensing the instantaneous rotational speed of the camshaft and generating second signals indicative thereof; and interpolating the first signals based on the second signals to determine the instantaneous position of the camshaft and, in turn, generating third signals for actuating the solenoid valve based thereon.

One method of the present invention further includes the steps of generating fourth signals indicative of the angle through which the camshaft rotates during the flow of fuel from the pump; generating fifth signals indicative of the point in time marking the initiation of the flow of fuel from the pump; and generating the third signals for actuating the solenoid valve based on the interpolation of the first signals and based on the fourth and fifth signals.

Another method of the present invention includes the steps of sensing the average rotational speed of the camshaft and determining the desired volume of fuel to be pumped upon actuation of the solenoid valve, and using the same as input variables for at least one characteristic map to generate the fourth and fifth signals based thereon. The desired volume of fuel to be injected is preferably based on several input variables selected from the group including the average rotational speed of the camshaft, the ambient engine temperature, and the position of the gas pedal of the vehicle.

In one method of the present invention, the instantaneous rotational speed of the camshaft and, thus, the second signals indicative thereof are continuously generated, and the interpolation of the first signal is based on the second signal generated immediately prior thereto. Preferably, the generation of the second signal and the interpolation of the first signal based thereon is performed within a time interval which expires prior to the initiation of the corresponding flow of fuel from the pump and includes both a measuring time component and a computing time component.

The present invention is also directed to an apparatus for controlling a fuel pump for an internal combustion engine of a vehicle. The apparatus comprises a fuel pump including a piston driven by a camshaft of the engine for pressurizing the fuel located therein. A solenoid valve of the apparatus is coupled to the fuel pump and adapted to be actuated to open the fuel pump to initiate the flow of fuel therefrom and, in turn, actuated to close the fuel pump and stop the flow of fuel therefrom.

An increment member of the apparatus is coupled to the camshaft of the engine and rotatable therewith. The increment member includes a plurality of spaced angular marks located thereon. The apparatus further includes first means for sensing the passing of each spaced angular mark on the increment member upon rotation of the camshaft and for generating first signals, each first signal being indicative of the passing of a respective angular mark. The apparatus further includes second means for sensing the instantaneous rotational speed of the camshaft and for generating second signals indicative thereof.

A control unit of the apparatus is coupled to the first and second means to receive the first and second signals therefrom and coupled to the solenoid valve. The control unit is adapted to interpolate the first signals based on the second signals to determine the substantially instantaneous position of the camshaft and, in turn, to transmit third signals to the solenoid valve based thereon to actuate the solenoid valve.

In one apparatus of the present invention, the angular marks on the increment member are each spaced relative to the next a distance defined by an angle equal to 3 degrees. The apparatus also comprises third means for sensing the angle through which the camshaft of the engine is rotated during the flow of fuel from the pump and for transmitting fourth signals indicative thereof to the control unit. The apparatus also comprises fourth means for sensing the point in time marking the initiation of the flow of fuel from the pump and for transmitting fifth signals indicative thereof to the control unit. The control unit is in turn further adapted to transmit the third signals for actuating the solenoid valve based on the fourth and fifth signals.

Thus, one advantage of the method and apparatus of the present invention, is that because of the interpolation between the individual pulses of the increment member, both the beginning of the fuel injection as well as the end of the fuel injection are accurately calculated. By using the instantaneous rotational frequency determined immediately before interpolating, the accuracy of the interpolated value is considerably increased over known methods and apparatus.

Other objects and advantages of the method and apparatus of the present invention will become apparent in view of the following detailed description and drawings taken in connection therewith.

DETAILED DESCRIPTION

Figure 1:
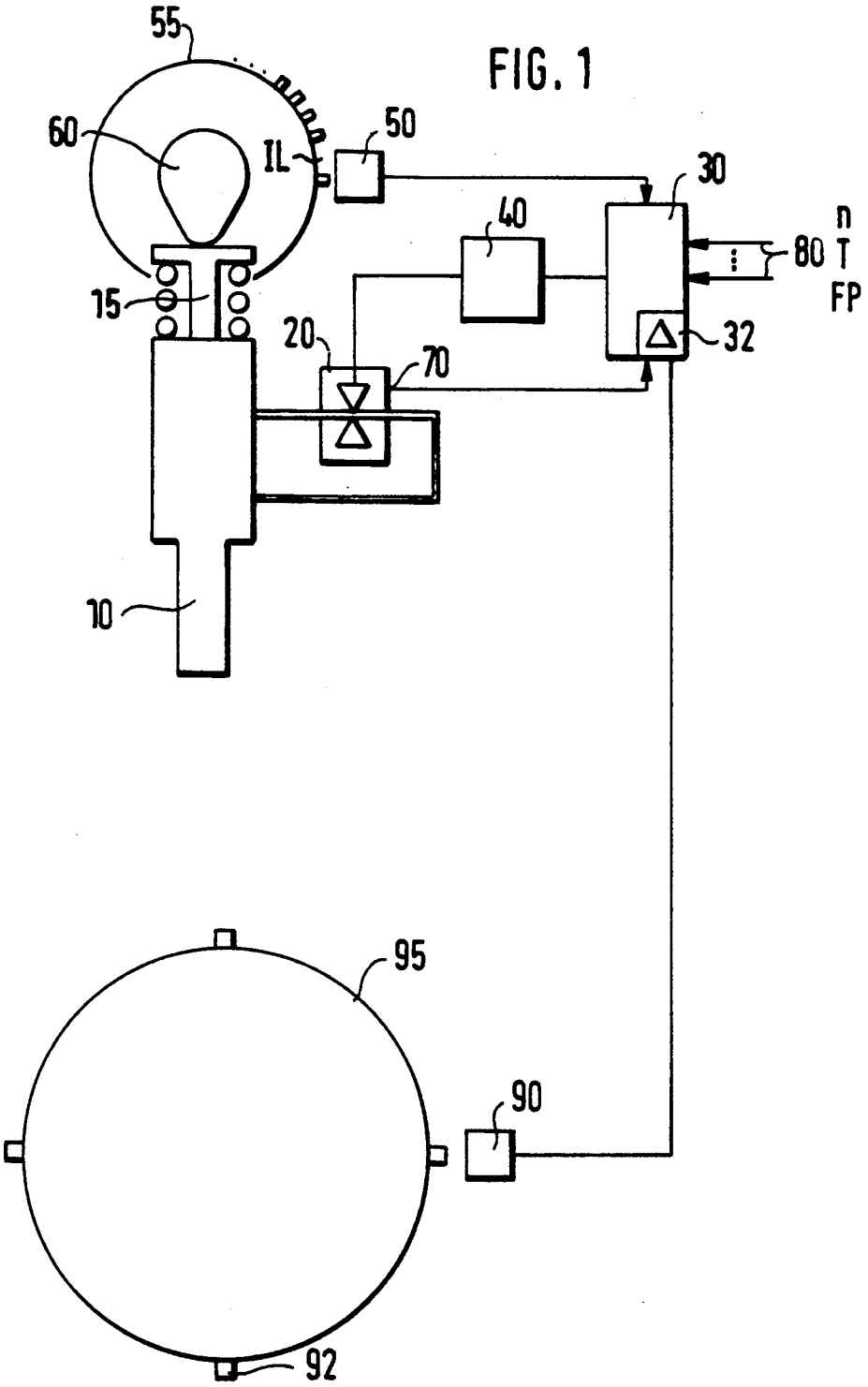
FIG. 1 is a schematic illustration of an apparatus embodying the present invention for controlling a fuel pump of an internal combustion engine.

In FIG. 1, an apparatus embodying the present invention for controlling a solenoid valve of a fuel pump for an internal combustion engine, such as a gasoline or diesel engine, is illustrated. Fuel is supplied by a fuel pump 10, which includes a pump piston 15, to the individual cylinders of the engine (not shown). The fuel pump 10 is coupled to an electromagnetic or solenoid valve 20. A power output stage 40 is controlled by an electronic control unit 30 to transmit switching pulses to the valve 20. The electronic control unit 30 includes a controller 32, of a type known to those of ordinary skill in the art. A detector 70, also of a type known to those of ordinary skill in the art, is mounted on the valve 20, or can be mounted on an injection nozzle (not shown). The detector 70 transmits signals to the electronic control unit 30.

An increment wheel 55 is mounted on a camshaft 60 of the engine, and includes a plurality of spaced angular marks thereon formed, for example, by teeth, as shown in FIG. 1. The increment wheel 55 includes at least one increment gap IL defined between the angular marks. The increment gap IL is equal, for example, to the space defined by a missing tooth, as shown in FIG. 1. A tooth which differs from the remaining teeth (not shown), however, can be used instead of a missing tooth to define the increment gap IL. A first measuring device 50 senses the pulses of the passing angular marks and, thus, measures the rotational motion of the increment wheel 55 and, in turn, transmits signals indicative thereof to the electronic control unit 30.

A second measuring device 90 senses the presence of marks 92 on a transmitting wheel 95 mounted on the crankshaft of the engine (not shown) and, in turn, transmits signals indicative thereof to the electronic control unit 30. Signals indicative of additional variables, such as rotational frequency n, temperature T, or the load FP based, for example, on the gas pedal position, are preferably transmitted to the electronic control unit 30 through additional inputs 80.

Figure 6:
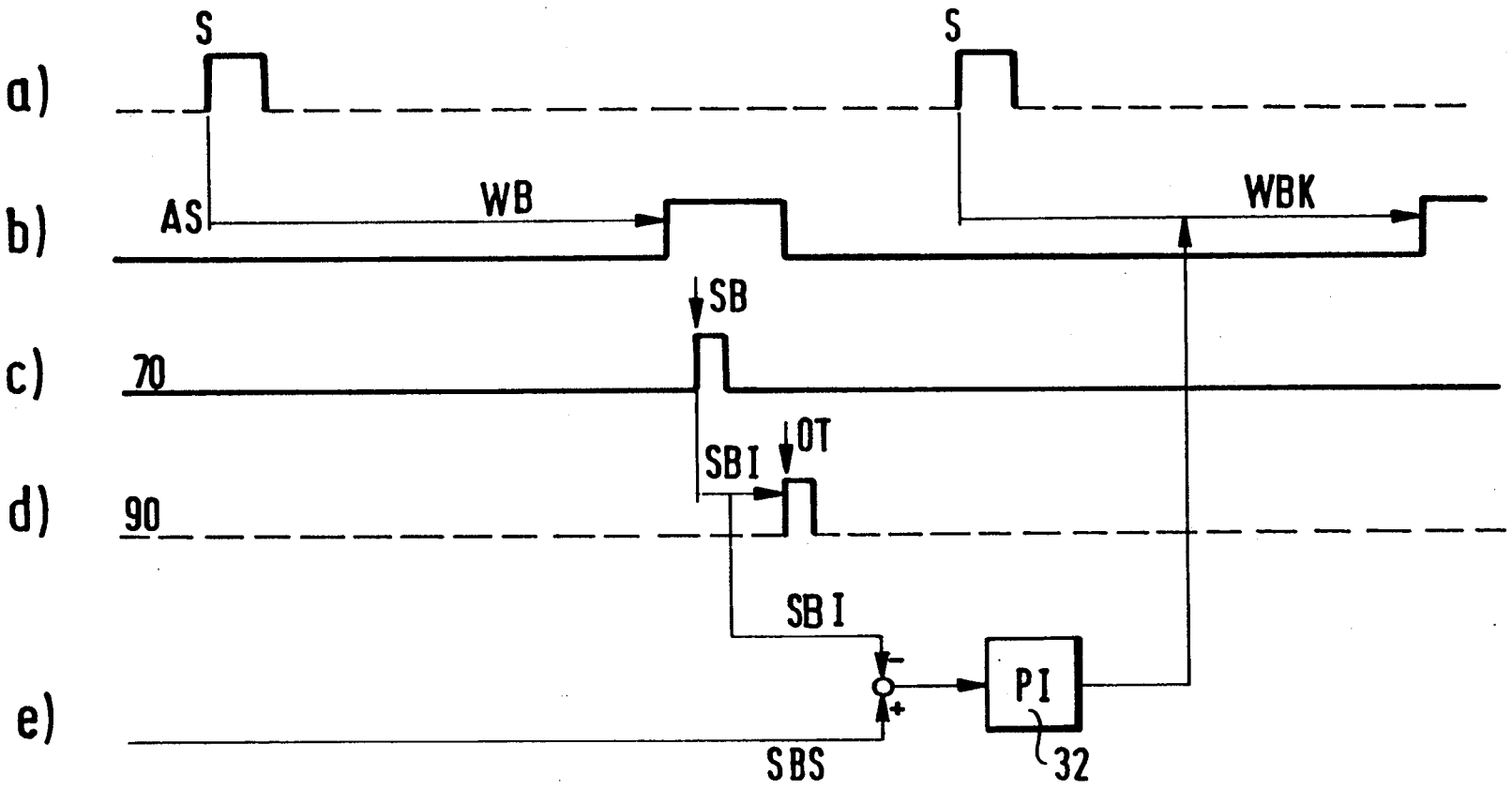
FIG. 6 includes several graphs (a–e) illustrating the sequence of various signals of the apparatus of FIG. 1 for regulating the beginning of the injection of fuel for an engine.

Based upon the variables detected across the inputs 80, and the rotational motion of the camshaft 60 against the pump 10 (as indicated by the first measuring device 50), the control unit 30 determines the beginning of the fuel output flow (flow-start angle) WB and the flow-output angle (flow-duration angle) WD of the fuel pump 10. Based on the values indicative of the beginning of the fuel output flow WB and the output-flow angle WD, the control unit 30 then calculates the beginning and the end of the trigger signal AS, as shown in FIG. 6, for the power output stage 40 to, in turn, switch the solenoid valve 20.

Figure 2:
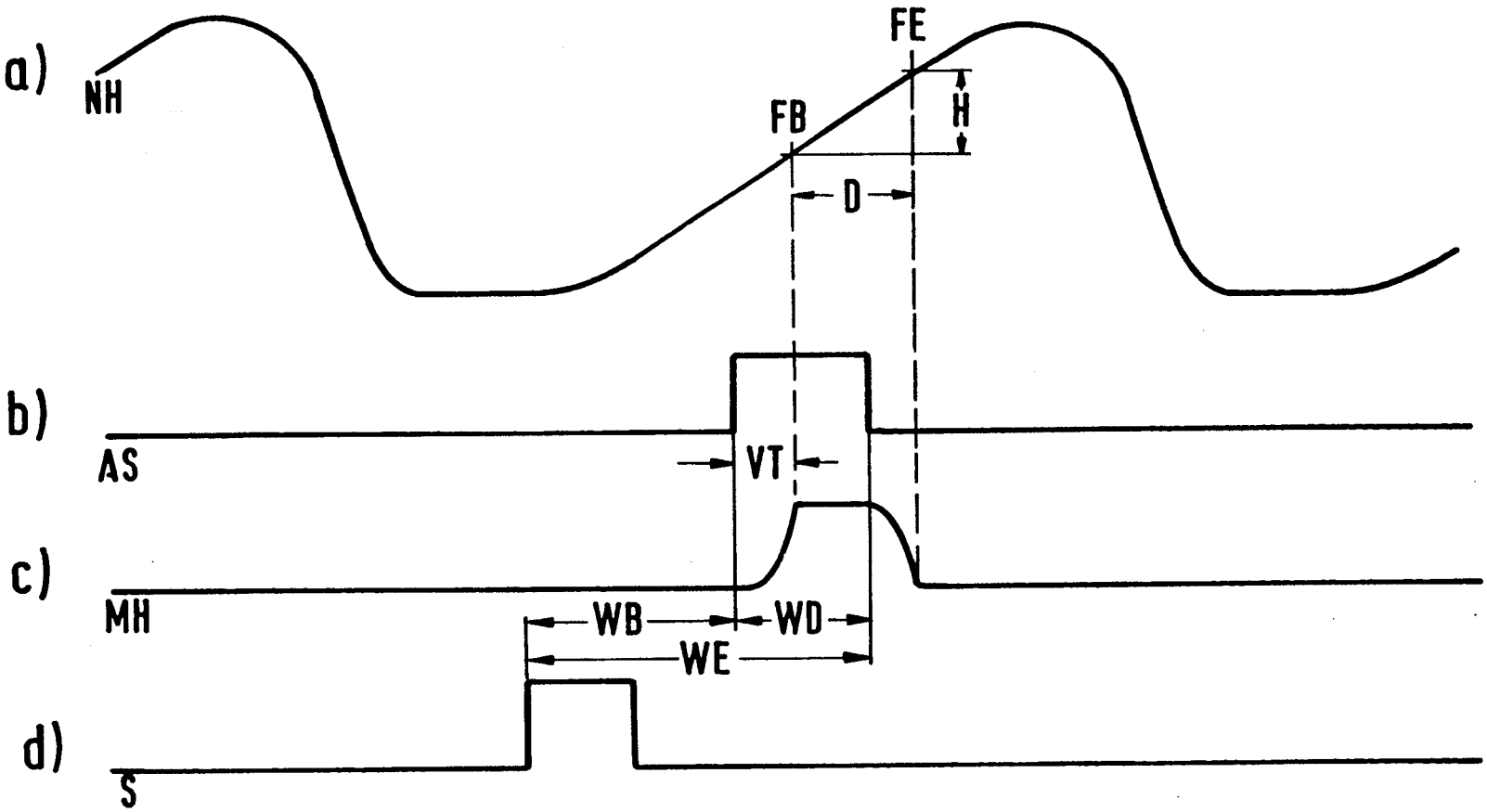
FIG. 2 includes several graphs (a–d) illustrating the correlation between the lift of the cam, the trigger signal of the solenoid valve, the lift of the solenoid valve, and the synchronizing pulse of the apparatus of FIG. 1.

As shown in FIG. 2, at the instant WB, the solenoid valve 20 assumes a first position in which the pump 10 delivers fuel for injection. Then, at the instant WE, the electromagnetic valve 20 assumes a second position, in which the fuel pump 10 no longer injects. One or more of the variables, such as the rotational frequency n, the temperature value T, the signal FP (which is preferably indicative of the position of the gas pedal), and the desired driving speed can be entered into the control unit 30 as operating characteristics.

The camshaft 60 drives the pump piston 15 so that the fuel in the fuel pump 10 is pressurized, and the solenoid valve 20 controls the pressure build-up therein. The solenoid valve 20 is preferably mounted on the pump 10 so that the fuel output flow is initiated by closing the valve. As will be recognized by those skilled in the art, however, the solenoid valve 20 can also be mounted in such a way that the fuel output flow is initiated by opening the valve. The method of the present invention can be employed with either of these solenoid valve configurations.

If the solenoid valve 20 is configured so that when it is open, there is no pressure build-up in the fuel pump 10, then such a pressure build-up occurs only when the valve 20 is closed. When a suitable pressure is reached in the fuel pump 10, the valve 20 is opened, and fuel is then injected into a combustion chamber of the engine through an injection nozzle (not shown).

The detector 70 controls the instants upon which the solenoid valve 20 opens and closes. It is particularly advantageous, therefore, to mount the detector 70 on the injection nozzle (not shown). The detector 70 thus generates signals indicative of the actual beginning WB, and the end WE of the injection of fuel into the combustion chamber.

The controller 32 then compares the output signal of the detector 70 and the signal of the second measuring device 90 to a predetermined setpoint value. If there is a deviation, the controller 32 correspondingly modifies the value of the beginning of the fuel output flow WB to equal the setpoint value. Instead of the output signal from the detector 70, however, a signal indicative of the position of the solenoid valve 20 can equally be used. This signal can be obtained by evaluating the electric current flowing through the solenoid valve 20 or the voltage applied thereto.

FIG. 2*a* is a graph NH illustrating the lift of the cam over somewhat more than a single combustion cycle. FIG. 2*b* is a graph illustrating the trigger signal AS for the solenoid valve 20 corresponding to the lift of the cam as illustrated in FIG. 2*a*. FIG. 2*c* is a graph illustrating the lift MH of the solenoid valve 20 corresponding to the lift of the cam as shown in FIG. 2*a*. And FIG. 2*d* is a graph illustrating the synchronizing pulse S corresponding to the lift of the cam as shown in FIG. 2*a*.

Starting from the synchronizing pulse S, the beginning of the fuel output flow WB and the end of the fuel output flow, (flow-end angle) WE are defined, as shown in FIG. 2*d*. At the end of the fuel output flow WB (after the synchronizing pulse S), the electronic control unit 30 transmits a trigger signal AS to the solenoid valve 20, as shown in FIG. 2*b*. After a short time delay VT, the solenoid valve 20 passes into its second circuit state, as shown in FIGS. 2*b* and 2*c*. The fuel pump 10 then initiates the delivery of fuel at the instant FB, as indicated in FIG. 2*a*.

After the solenoid valve 20 passes through the angle WD and, thus, establishes the duration D of the fuel output flow, the trigger signal AS is cancelled. After an additional time delay, the solenoid valve 20 then opens and, thus, ends the delivery of fuel at the instant FE, as shown in FIG. 2*a*. In the time interval between the closing FB and the opening FE of the solenoid valve 20, the cam movement NH increases vertically a distance H, which is typically called the lift of the cam. The lift of the cam H thus determines the injected volume of fuel. The injected volume of fuel is, accordingly, directly proportional to the lift of the cam H.

If the camshaft speed c is constant, then the determination of the injected volume of fuel does not depend on the beginning of the fuel output flow WB. The ratio of the lift of the cam H to the time elapsed for achieving that lift is designated as the camshaft speed c. If the camshaft speed c is not constant, and if the duration WD of the trigger signal AS for the solenoid valve 20 is the same, but, however, there is a change in the beginning of the fuel output flow WB, then there is a corresponding change in the volume of fuel injected. A camshaft speed c that is not constant can be based, for example, on a rotational frequency that changes during the course of the injection of fuel.

Figure 3:
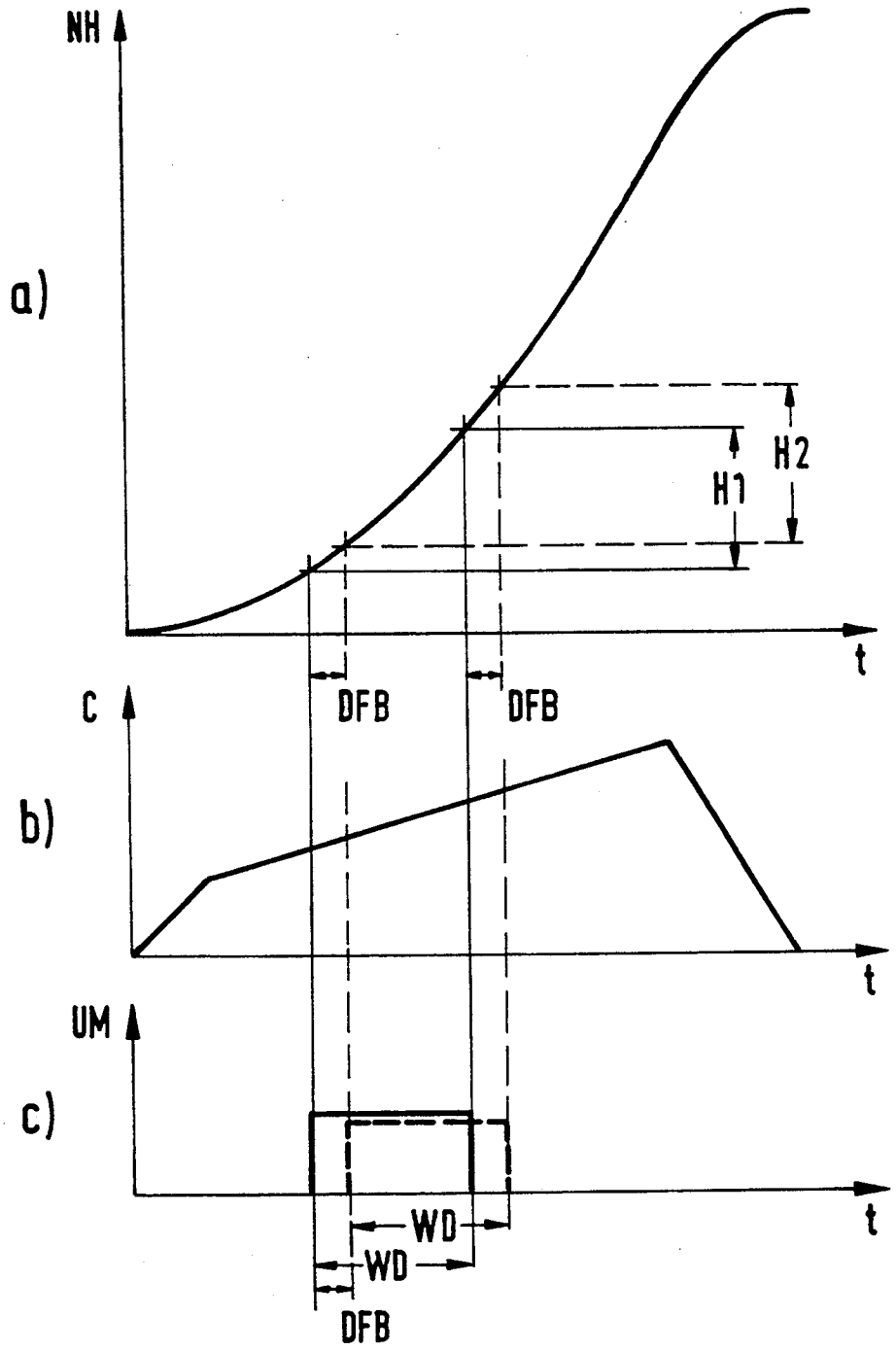
FIG. 3 includes several graphs (a–c) illustrating the volume dispersion which occurs when the beginning of the fuel output flow varies.

In FIG. 3*a*, a graph NH indicative of the movement of the cam and, thus, the lift of the cam H, is plotted with respect to time t. The camshaft speed c is plotted with respect to time t in FIG. 3*b* and, as can be seen, it initially increases with time. The voltage UM applied to the solenoid valve 20 for two meter-in flow controls Z1 and Z2 (Z1 is the solid line and Z2 is the dotted line) is plotted with respect to time t in FIG. 3*c*. There is only a small disparity DFB between the starting points WB of the two meter-in flow controls Z1 and Z2 As shown in FIG. 3*c*, the flow-output angle WD is the same for both meter-in flow controls Z1 and Z2. If the camshaft speed c increases with time, then, as shown in FIGS. 3*a* and 3*c*, there is a lift of the cam H1 for the first meter-in flow control Z1, and a lift of the cam H2 for the second meter-in flow control Z2. As also shown in FIG. 3*a*, the cam moves during the first meter-in flow control Z1 by a lift H1, which is less than the corresponding lift H2 of the second meter-in flow control Z2. Therefore, for the second meter-in flow control Z2, there is a greater volume of fuel injected than there is for the first meter-in flow control Z1.

Thus, due to the different rotational frequency progressions during the fuel injection process, it is not possible to have an accurate pure time control system. The changes in rotational frequency can be caused, for example, by the elasticity of the drive coupling between the crankshaft (not shown) and the camshaft 60.

The volume of fuel injected Q into the gasoline engine, therefore, not only depends on the instant at which the solenoid valve 20 closes, but also on the instantaneous rotational frequency N of the camshaft 60. In this case, Q is defined as follows:

$$Q = \text{flow-output rate} * WD$$

The flow-output rate characterizes the volume of fuel injected per unit of angle of rotation of the camshaft 60. The fuel flow-output angle WD is defined as follows:

$$WD = 6 * N * D$$

D is the duration of the fuel flow output, as described above, and N is the rotational frequency of the camshaft 60. To reduce the dependency of the volume of fuel injected Q on random changes in the rotational frequency N, a meter-in flow control is performed in accordance with the method and apparatus of the present invention, as hereinafter described.

The electronic control unit 30 transmits signals to the final stage 40 for triggering the final stage and, in turn, the solenoid valve 20. The electronic control unit 30 is illustrated schematically in further detail in FIG. 4. The electronic control unit 30 includes a computer 110, characteristic maps K1 and K2 coupled thereto, and a metering computer 120 coupled to the characteristics maps K1 and K2.

A rotational-frequency sensor 125 detects the instantaneous rotational frequency N of the camshaft 60 and transmits signals indicative thereof to the metering computer 120. Also, signals indicative of the desired fuel flow-output angle WD and the beginning of the fuel flow output WB, are transmitted to the metering computer 120 by the characteristic maps K1 and K2, respectively. The average rotational frequency nM and the desired volume of fuel injected Q serve as input variables for the characteristic maps K1 and K2. The signal Q is transmitted by the computer 110 to the characteristic maps K1 and K2. The computer 110 calculates the value of Q based upon various input variables generated by sensors 80 coupled thereto.

The input variables generated by the sensors 80 preferably include the average rotational frequency nM, temperature T, gas pedal position FP, and, if desired, additional operating characteristic quantities known to those of ordinary skill in the art. Based upon the value of Q, and the average rotational frequency nM, a signal indicative of the fuel output-flow angle WD is transmitted by the characteristic map K1 to the metering computer 120. The fuel output-flow angle WD can then be used to determine the volume of fuel to be injected Q. The fuel output-flow angle WD is the angle traversed by the camshaft 60 while the fuel pump 10 is delivering fuel.

The average rotational frequency nM of the camshaft 60 can be derived using sensors known to those of ordinary skill in the art. As a rule, the sensor is preferably adapted to detect the pulses generated both by a pulse wheel on the crankshaft and by a pulse wheel on the camshaft. The rotational frequency is therefore averaged over a larger angular range and over several revolutions of the camshaft. The average rotational frequency signal nM, however, can also be generated by a substitute sensor for sensing the rotational frequency, such as a sensor which also senses the beginning of the injection of fuel WB.

Based upon the volume of fuel injected Q and the average rotational frequency nM, a signal indicative of the beginning of the fuel output flow WB is transmitted by the second characteristic map K2 to the metering computer 120. Based also upon the instantaneous rotational frequency N of the camshaft 60 generated by the sensor 125, the metering computer 120 converts the angular signal WD and the fuel flow output signal WB into time variables. The time variables are then used to determine the trigger signal AS for the solenoid valve 20. The metering computer 120 therefore establishes the instants upon which the voltage applied to the solenoid valve 20 changes, as shown in FIG. 2*b*. These values are then transmitted by the metering computer 120 to the final stage 40 of the solenoid valve 20, which then converts the signals into a trigger signal AS.

Figure 5:
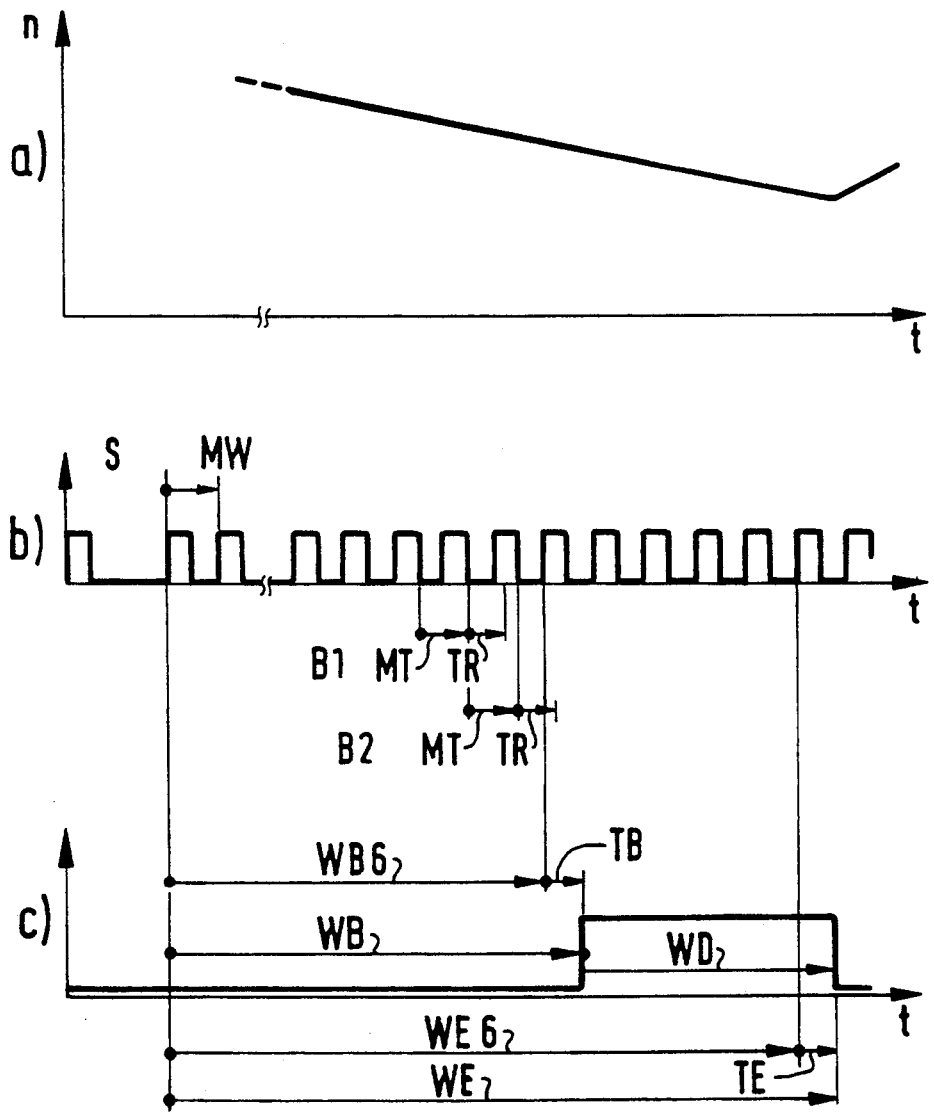
FIG. 5 includes several graphs (a–c) illustrating the relationship of the trigger signal of the apparatus of FIG. 1 to the rotational frequency of the camshaft of an engine and the pulses generated by an angular increment wheel mounted thereon.

The conversion of the angular variables into the time variables by the metering computer 120 is illustrated schematically in FIG. 5. FIG. 5*a* is a graph illustrating a customary rotational frequency pattern n with respect to time t during meter-in flow control. As can be seen, during the course of the meter-in flow control, the rotational frequency n decreases linearly over time.

The graph in FIG. 5*b* illustrates the pulses S sensed by the first measuring device 50 from the increment wheel 55 with respect to time t. Each angular mark on the increment wheel 55 generates a pulse which, in turn, is sensed by the first measuring device 50. It is particularly advantageous when the distance between the angular marks MW (referred to as the measuring angle) is less than the smallest fuel flow-output angle WD. Preferably, the measuring angle is equal to 3°. In this case, 120 equal spaced angular marks, thus forming a 3° clearance between adjacent marks, are formed on the increment wheel 55 of the camshaft 60. This type of an increment wheel 55 is particularly suited for engines including four, five, six, and eight cylinders. At least one increment gap IL, which generates the synchronizing pulse S, is formed on the increment wheel 55 for purposes of synchronization. Based on the synchronizing pulses S, the angle for the beginning of the fuel output flow WB, and the angle for the end of the fuel output flow WE are specified.

The meter-in flow control for fuel takes place as a function of the angle of the fuel output flow WD, which is defined between the beginning of the fuel output flow WB and the end of the fuel output flow WE, as shown in FIG. 5*c*. The angle WB, as shown in FIG. 5*c*, is divided into an integral angular component WBG and a residual angular component RWB corresponding to a remaining time period TB.

Figure 4:
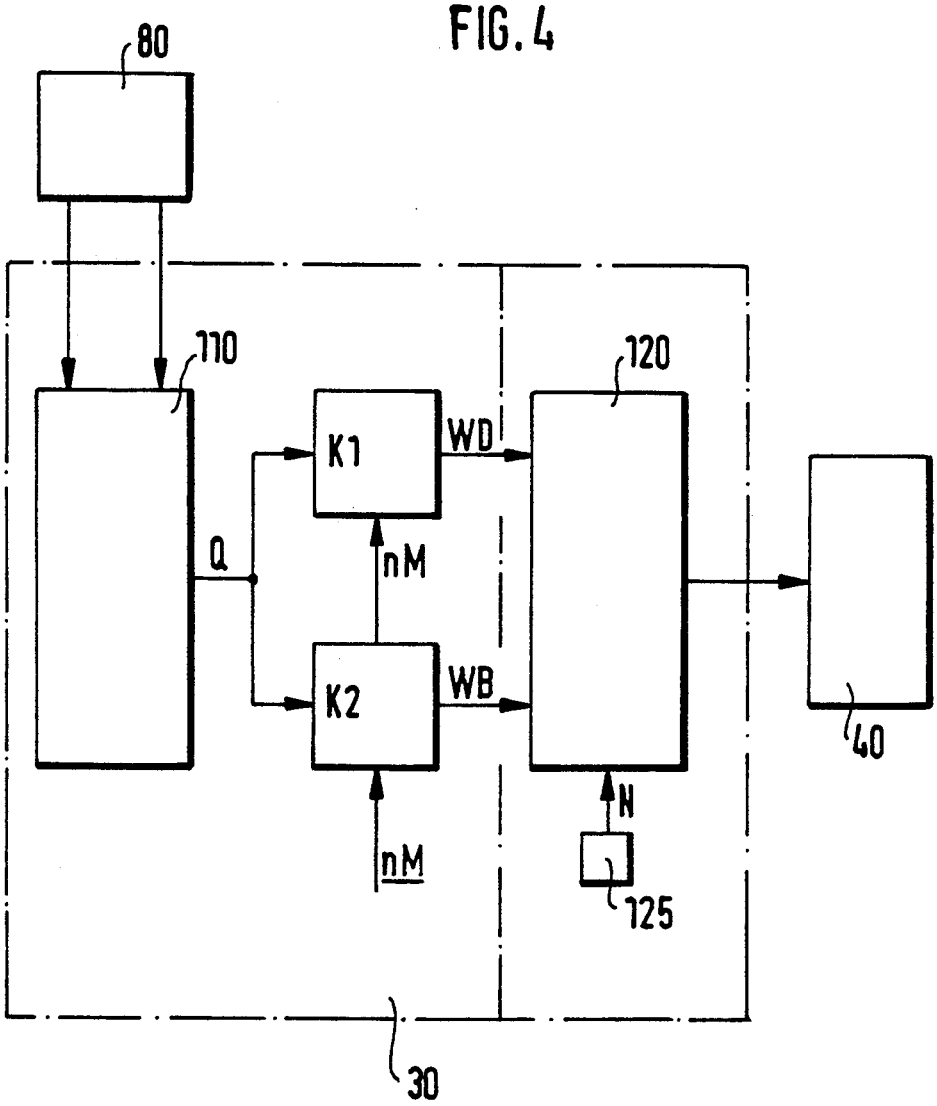
FIG. 4 is a further detailed schematic illustration of the electronic control unit of the apparatus of FIG. 1.

As also shown in FIG. 5*c*, the angle WE is likewise divided into an integral angular component WEG, and into a residual angular component RWE, which corresponds to a remaining time period TE. The residual angular components RWB and RWE are converted into the remaining time periods TB and TE based upon the instantaneous rotational frequency N generated by the sensor 125, as shown in FIG. 4. The respective remaining time periods T (TB and TE) based on the residual angular components RWB and RWE, respectively, and the instantaneous rotational frequency N, are defined based on the following equation:

$$T = RW/(6 * N).$$

The rotational frequency basis RW for interpolating the time periods TB and TE is equal to a measuring angle MW, the value of which is as close as possible to the respective interpolation segment. By using the most current rotational frequency value N possible, the effect of errors can be correspondingly minimized.

In FIG. 5*b*, a first interpolation is indicated by the reference character B1. As can be seen, the camshaft 60 traverses a measuring angle MW within a measuring time period MT. A first value for the instantaneous rotational frequency N is calculated, and the interpolation is then performed within a computing time period TR. At the end of the computing time period TR, the actual time period available before the beginning of the fuel output flow WB is greater than TB. In any event, the computing time period TR must expire before the meter-in flow control begins. If the beginning of the fuel flow output WB is not yet reached after the first calculation B1, as shown in FIG. 5*c*, then another interpolation is performed. The instantaneous rotational frequency N is therefore determined, and the second interpolation B2 is performed within the computing time period TR, which is based on a second measuring angle MW of the camshaft 60 during a second measuring time period MT.

Thus, the interpolation errors typically caused by changes in the camshaft rotational frequency can be minimized by repeatedly calculating the instantaneous rotational frequency value N. The determination of the instantaneous camshaft rotational frequency N, and the interpolation must start, at the latest, within the measuring time period MT and the computing time period TR, and thus before the beginning of the fuel output flow WB. Preferably, the determination of the camshaft rotational frequency N and the interpolation are performed within a time interval equal to the sum of the measuring time period MT and the computing time period TR, and before the desired beginning of the fuel output flow WB.

The process is then repeated for the end of the fuel output flow WE. Thus, a first value for the instantaneous rotational frequency N is calculated and the interpolation is performed within an additional computing time period TR. Upon the termination of the computing time period TR, the actual time period TE remains before the end of the fuel output flow WE. In any event, the computing time period TR must expire before the meter-in flow control ends. If the angle WE of the end of the fuel output flow is not yet reached, then another interpolation is performed. Thus, the instantaneous rotational frequency N is again determined, and the interpolation is performed based on another measuring angle MW.

The interpolation errors caused by changes in the camshaft rotational frequency can thus be minimized by repeatedly calculating the instantaneous rotational frequency value N. The sensing of the instantaneous camshaft rotational frequency N and the interpolation must start, at the latest, within the period defined by the measuring time period MT and the computing time period TR and before the end of the fuel output flow WE. Preferably, the sensing of the camshaft rotational frequency N and the interpolation are performed within a time interval equal to the sum of the measuring time period MT and the computing time period TR and before the desired end of the fuel output flow WE.

The end of the fuel output flow WE is calculated based on the actual beginning of the fuel output flow WB. Thus, errors made in calculating the time remaining for the beginning of the fuel output flow WB can be compensated for in the calculation of the end of the fuel output flow WE.

For systems with both preliminary fuel injection and main fuel injection stages, the beginning of the fuel output flow and the end of the fuel output flow for the preliminary and the main fuel injection stages are calculated in accordance with the method and apparatus of the present invention as hereinafter described. Because the angles for the beginning of the fuel output flow and the end of the fuel output flow are determined by counting integral angular marks and by means of a subsequent time interpolation, an incremental-angle time system can be used as the metering principle.

To synchronize cylinders, at least one increment gap IL is defined on the increment wheel 55, as described above. Optionally, Z-gaps can also be formed and, accordingly, cylinder recognition would also be necessary. As will be recognized by those skilled in the art, the synchronizing gap can also be replaced with an appropriate synchronizing mark, which is distinguishable from the remaining marks on the increment wheel 55.

To obtain optimum combustion of the fuel, the fuel injection must take place at the correct positions of the respective pistons of the gasoline engine. The beginning of the fuel output flow, and thus the beginning of the fuel injection are related to the compression point of the engine and to the position of the crankshaft. The beginning of the fuel output flow is optimally adjusted when it is based on signals generated by a sensor at the crankshaft.

If the beginning of the fuel output flow is based on signals from the camshaft, then deviations from the specified optimum beginning of the fuel output flow can result therefrom. The deviations are typically caused by various limiting parameters, such as elasticities between the camshaft and the crankshaft drive. These types of systematic deviations can be eliminated, however, by means of a closed-loop control system.

The graphs in FIG. 6 illustrate the operation of a closed-loop control system of the present invention. In FIG. 6*a*, the occurrence of the synchronizing pulse S is plotted with respect to time. In FIG. 6*b*, the trigger signal AS is plotted with respect to time t. In FIG. 6*c*, the signal SB, which characterizes the actual beginning of injection of fuel, is plotted with respect to time t. The signal SB is generated by the detector 70 illustrated in FIG. 1.

In FIG. 6*d*, the signal TO, which is generated by the second measuring device 90, as shown in FIG. 1, is plotted with respect to time t. This signal is narrowly correlated with the compression point of the pistons of the engine. The interval SBI between the beginning of the signal SB, which characterizes the actual beginning of the injection of fuel, and the beginning of the signal OT generated by the second measuring device 90, is transmitted to the controller 32, as shown in FIGS. 6*c*–6*e*. The interval SBI can be indicated either in angular variables or in units of time.

The controller 32 of the present invention possesses at least P proportional action. It is particularly advantageous when it also contains an integral-action component. The controller 32 compares the signal SBI, which indicates the actual beginning of the injection of fuel, to a specified setpoint value SBS, as indicated in FIG. 6*e*. Based upon this comparison, the beginning of the fuel output flow WB is corrected. Then, during the next meter-in flow control, the trigger signal is not released at what would otherwise have been the beginning of the fuel output flow WB, but rather is released at the corrected beginning of the fuel output flow WBK.

The trigger signal S is released based on a synchronizing mark on the camshaft, as described above. The actual beginning of the injection of fuel SB, however, is determined based on a measuring mark OT on the crankshaft. The measuring mark OT is preferably configured within the range of the compression point. Accordingly, the beginning of the injection of fuel WB occurs at an optimum moment with respect to the position of the crankshaft. This signal processing is preferably performed either in angular or time variables, or a combination of both.

Thus, one advantage of the method and apparatus of the present invention, is that because the beginning of the fuel flow output is regulated based on a signal corresponding to the position of the crankshaft, and because the calculation of the volume of fuel injected is based upon the movement of the camshaft, a very exact meter-in fuel flow control is obtained.

It should be pointed out that many changes can be made to the apparatus and method of the present invention as described herein, without departing from the scope of the claims. For example, if necessary, to eliminate interference effects, the increment wheel 55 can also be mounted on the crankshaft. For purposes of synchronizing the cylinders, however, a segment wheel would then be mounted on the camshaft 60. As will also be recognized by those skilled in the art, it can be particularly advantageous to include increment wheels 55 arranged on both the camshaft 60 and on the crankshaft.

We claim:

1. A method for controlling a fuel pump for an internal combustion engine of a vehicle, the fuel pump including a piston driven by a camshaft of the engine for pressurizing the fuel located in the fuel pump, the method comprising the following steps:

determining a quantity of fuel to flow from the fuel pump based on at least one input variable indicative of an operating condition of the vehicle;

continuously measuring an instantaneous rotational speed of the camshaft;

determining a flow-start angle and a flow-end angle, each angle being based on the determined quantity of fuel to flow from the fuel pump and the current average value of the measured rotational speed of the camshaft;

dividing the flow-start angle into a first integral angle and a first residual angle, converting the first residual angle into a first residue time value based solely on the current instantaneous rotational speed of the camshaft measured immediately prior to the conversion of the first residual angle, and generating a trigger signal for initiating the flow of fuel from the fuel pump upon expiration of the first residual time value; and dividing the flow-end angle into a second integral angle and a second residual angle, converting the second residual angle into a second residual time value based solely on the current instantaneous rotational sped of the camshaft measured immediately prior to the conversion of the second residual angle, and terminating the trigger signal for stopping the flow of fuel from the fuel pump upon expiration of the second residual time value.

2. A method for controlling a fuel pump as defined in claim 1, wherein the first and second integral angles each corresponds to a number of spaced angular marks located on the camshaft.

3. A method for controlling a fuel pump as defined in claim 1, wherein the at least one input variable is selected from the group including the average rotational speed of the camshaft, the ambient engine temperature, and the position of the gas pedal of the vehicle.

4. An apparatus for controlling a fuel pump for an internal combustion engine of a vehicle, comprising:

a fuel pump including a piston driven by a camshaft of the engine for pressurizing the fuel located in the fuel pump;

a sensor for detecting at least one input variable indicative of a quantity of fuel to flow from the fuel pump and transmitting an output signal in response;

a measuring device for continuously measuring an instantaneous rotational speed of the camshaft;

a first processing unit coupled to an output of the sensor and to the measuring device for determining the quantity of fuel to flow from the fuel pump in response to the output signal from the sensor and for determining a flow-start angle and a flow-end angle based on the determined quantity of fuel and the current average value of the measured rotational speed of the camshaft;

a second processing unit coupled to an output of the first processing unit and an output of the measuring device for dividing the flow-start angle into a first integral angle and a first residual angle, for converting the first residual angle into a first residual time value based solely on the current instantaneous rotational speed of the camshaft measured immediately prior to the conversion of the first residual angle, for generating a trigger signal for initiating the flow of fuel from the fuel pump upon expiration of the first residual time value, and for dividing the flow-end angle into a second integral angle and a second residual angle, for converting the second residual angle into a second residual time value based solely on the current instantaneous rotational speed of the camshaft measured immediately prior to the conversion of the second residual angle, and for terminating the trigger signal for stopping the flow of fuel from the fuel pump upon expiration of the second residual time value.

5. An apparatus for controlling a fuel pump as defined in claim 4, wherein the first and second integral angles each corresponds to a number of spaced angular marks located on the camshaft.

6. An apparatus for controlling a fuel pump as defined in claim 4, wherein the at least one input variable is selected from the group including the average rotational speed of the camshaft, the ambient engine temperature, and the position of the gas pedal of the vehicle.

* * * * *

UNITED STATES PATENT AND TRADEMARK OFFICE

CERTIFICATE OF CORRECTION

PATENT NO. : 5,267,546

DATED : DEC. 7, 1993

INVENTOR(S) : Seibert, Hans-Joachim et al.

It is certified that error appears in the above-indentified patent and that said Letters Patent is hereby corrected as shown below:

Column 1, line 5, change "Aug." to --Jan.--;
line 7,8 delete --Method and Apparatus for Controlling A Fuel Pump-- and insert same title immediately after the word "entitled" in line 5.

Column 6, line 50, change "Z2. If the" to --Z2.
If the--; (new paragraph)

Column 10, line 48, change "TO" to --OT--.

Signed and Sealed this

Seventeenth Day of January, 1995

Bruce Lehman

*Attest:*

BRUCE LEHMAN

*Attesting Officer*

*Commissioner of Patents and Trademarks*